US009604126B2

(12) United States Patent
Kadile

(10) Patent No.: US 9,604,126 B2
(45) **Date of Patent: *Mar. 28, 2017**

(54) PLAY SET FOR LAUNCHING AN ACTION FIGURINE

(71) Applicant: Mattel, Inc., El Segundo, CA (US)

(72) Inventor: Michael A. Kadile, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/549,710

(22) Filed: Nov. 21, 2014

(65) Prior Publication Data

US 2015/0140891 A1 May 21, 2015

Related U.S. Application Data

(60) Provisional application No. 61/907,116, filed on Nov. 21, 2013.

(51) Int. Cl.
*A63H 3/52* (2006.01)
*A63H 13/06* (2006.01)
*A63C 19/00* (2006.01)

(52) U.S. Cl.
CPC ..... *A63C 19/005* (2013.01); *A63H 3/52* (2013.01); *A63H 13/06* (2013.01)

(58) Field of Classification Search
CPC . A63H 3/50; A63H 3/52; A63H 13/06; A63H 29/18; A63H 33/18; A63F 9/052; A63F 9/0278; A63F 9/0252; A63F 2009/0265; A63F 2009/0273; A63F 9/02; A63C 19/005; A63C 19/00
See application file for complete search history.

(56) References Cited

U.S. PATENT DOCUMENTS

| | | | | |
|---|---|---|---|---|
| 485,896 A | | 11/1892 | Sterry, Jr. | |
| 1,435,326 A | | 11/1922 | Mullin | |
| 1,576,515 A | * | 3/1926 | Kinney | A63F 9/02 124/4 |
| 1,753,328 A | | 4/1930 | Barnes | |

(Continued)

FOREIGN PATENT DOCUMENTS

| | | |
|---|---|---|
| EP | 0 528 725 | 2/1993 |
| FR | 2 929 131 | 10/2009 |

OTHER PUBLICATIONS

English Abstract Translation for EP 0 528 725.

(Continued)

*Primary Examiner* — Gene Kim
*Assistant Examiner* — Alyssa Hylinski
(74) *Attorney, Agent, or Firm* — Kolisch Hartwell, P.C.

(57) ABSTRACT

A toy ring is disclosed herein. The toy ring having: a platform; a plurality of posts positioned about the platform, the plurality of posts including at least one launching post configured for movement between a first position and a second position, wherein movement from the first position to the second position is in a first direction away from the platform; an elastic member secured to each one of the plurality of posts, wherein the biasing member provides a biasing force to the launching post in a second direction opposite to the first direction when the launching post is in the second position.

21 Claims, 7 Drawing Sheets

(56) References Cited

U.S. PATENT DOCUMENTS 1,975,305 A * 10/1934 Wilder ..... A63H 3/52 446/482
2,119,327 A 5/1938 Gunnarson
2,204,078 A * 6/1940 Ferrary ..... A63F 9/02 273/336
2,243,943 A 6/1941 Bunting
2,267,865 A 12/1941 Hurley
2,622,835 A 12/1952 Ippolito
2,726,866 A 12/1955 Nally
2,832,174 A 4/1958 Yip
3,073,560 A 1/1963 Montgomery
3,235,259 A 2/1966 Glass et al.
3,409,295 A 11/1968 Bernstein
3,794,325 A * 2/1974 Stender ..... A63F 9/02 124/36
3,876,197 A 4/1975 Jenson
3,969,841 A 7/1976 Joseph
4,091,563 A * 5/1978 Noble ..... A63H 13/06 273/440.1
4,368,875 A 1/1983 Weiss et al.
5,186,119 A * 2/1993 Hlavin ..... E01F 9/629 116/201
6,220,577 B1 4/2001 Ostrow
6,325,692 B1 12/2001 Webb
6,340,334 B1 1/2002 Olsen et al.
7,007,420 B2 3/2006 Garcia
7,238,127 B2 7/2007 Al-Harbi
7,255,312 B2 8/2007 Melic
7,475,881 B2 * 1/2009 Blagg ..... A63F 9/00 273/440.1
7,510,152 B2 3/2009 Melic
8,808,054 B1 * 8/2014 Barthold ..... A63H 33/42 446/309
9,339,721 B2 * 5/2016 Kadile ..... A63C 19/005
2009/0020956 A1 1/2009 McCall
2009/0318056 A1 * 12/2009 Glover ..... A63H 13/06 446/383
2011/0012310 A1 1/2011 Anderton et al.
2012/0208427 A1 8/2012 Barthold et al.
2012/0264347 A1 * 10/2012 Barthold ..... A63H 33/42 446/75
2012/0316002 A1 * 12/2012 Antuna ..... A63C 19/005 472/93
2013/0017895 A1 1/2013 Mechling et al.
2013/0316613 A1 * 11/2013 O'Hare ..... A63H 33/00 446/487
2014/0073218 A1 * 3/2014 Barthold ..... A63H 7/00 446/268

OTHER PUBLICATIONS

English Abstract Translation for FR 2 929 131.
United States Patent and Trademark Office, Office Action for U.S Appl. No. 14/581,519, Oct. 23, 2015, 21 pages.

* cited by examiner

PLAY SET FOR LAUNCHING AN ACTION FIGURINE

CROSS REFERENCE TO RELATED APPLICATIONS

This application claims the benefit of U.S. Provisional Patent Application No. 61/907,116 filed Nov. 21, 2013, the entire contents of which are incorporated herein by reference thereto.

BACKGROUND

Various embodiments of the present invention are related to a play set or toy ring for use with an action figure or figurine wherein the toy ring or play set is configured to launch the action figure from a component of the play set or toy ring.

Children's toys have included miniature cars, boats, trains, figures, etc. wherein the user's imagination provides for hours of extended play and enjoyment. Toy figures that resemble real life characters are particularly popular as the user can participate in imaginary play that mimics real life activities and/or scenes.

Wrestling and/or boxing events provide fun and entertainment for both children and adults. Toy wrestling and boxing action figures and play pieces allow fans to reenact and create wrestling and boxing matches that resemble real-life wrestling and/or fighting activities.

Accordingly, it is desirable to provide a toy ring or play set that allows for simulated wrestling and/or fighting activities. It is also desirable to provide a toy that presents multiple play scenarios thereby increasing an end user's interaction with the toy, and encouraging imaginative play.

SUMMARY OF THE INVENTION

In one embodiment, a toy ring is provided. The toy ring having: a platform; a plurality of posts positioned about the platform, the plurality of posts including at least one launching post configured for movement between a first position and a second position, wherein movement from the first position to the second position is in a first direction away from the platform; an elastic member secured to each one of the plurality of posts; and a biasing member for providing a biasing force to the launching post in a second direction opposite to the first direction when the launching post is in the second position.

In another embodiment, a toy ring is provided. The toy ring having: a platform; a plurality of posts positioned about the platform, the plurality of posts including at least one launching post pivotally mounted to the platform at a first end and configured for movement between a first position and a second position, wherein a second end of the launching post, opposite the first end, moves in a first direction away from the platform when the launching post is moved from the first position to the second position; and an elastic member secured to each one of the plurality of posts, wherein the elastic member provides a biasing force to the launching post in a second direction opposite to the first direction when the launching post is in the second position.

In yet another embodiment, a toy wrestling ring and an action figure are provided. The toy wrestling ring having: a platform; a plurality of posts positioned about the platform, the plurality of posts including at least one launching post pivotally mounted to the platform at a first end and configured for movement between a first position and a second position, where a second end of the launching post, opposite the first end, moves in a first direction away from the platform when the launching post is moved from the first position to the second position; an elastic member secured to each one of the plurality of posts, wherein the elastic member provides a biasing force to the launching post in a second direction when the launching post is in the second position, the second direction being opposite to the first direction; and an action figurine configured to be removably secured to the second end of the launching post, such that movement of the launching post from the second position to the first position with the action figurine located on the second end of the launching post propels the action figurine into or over an area of the ring surrounded by the plurality of posts and the elastic member.

DETAILED DESCRIPTION

In accordance with various embodiments of the present invention a play set or toy ring 10 is provided. The play set or toy ring 10 has a plurality of posts 14, including at least one launching post. The launching post may be movable with respect to the toy ring 10 from a first or upright position (See at least FIGS. 1, 2A, 2B, 3A and 5) to a second or loaded position (See at least FIGS. 2C and 3B).

In some embodiments, the launching post is spring biased into the first position by a biasing member. Accordingly, the launching post is configured to pivot outwardly and away from the play set 10 towards the second position through application of a user-applied force. Once this force is released, the launching post springs back from the second position towards the first position until the post stops at the first position. When the post stops at the first position, an item or action figurine 21 removably secured to a portion of the post is thrown into the ring. Accordingly and when used in combination with a toy wrestling action figure or figurine 21, the launching post can be used to launch the action figure or figurine 21 across or into the play set 10.

Figure 1:
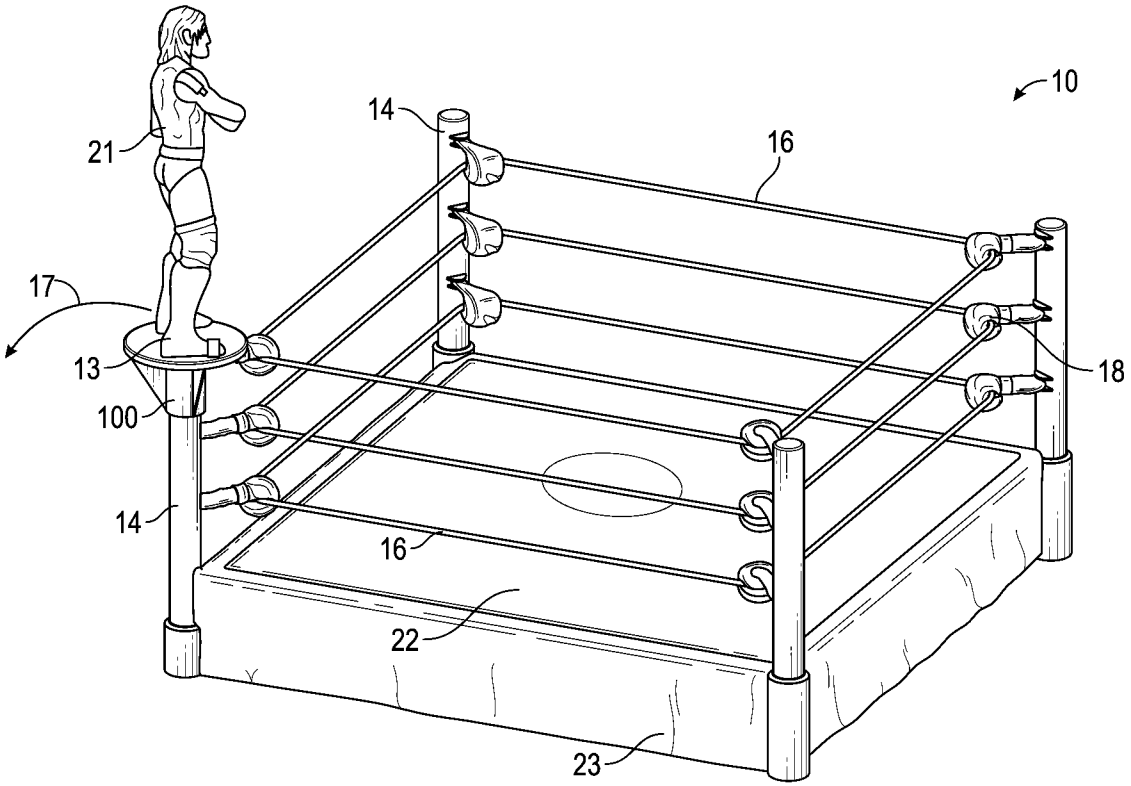
FIG. 1 is a perspective view of a play set or toy ring according to one embodiment of the present invention.

Referring to at least FIG. 1, the play set or toy ring 10 is configured to have four posts 14 located about the perimeter of the play set or toy ring 10. Each post 14 includes a plurality of turnbuckles 18 that are coupled to one or more elastic bands or elastic members that are positioned as elastically expandable ropes 16 that form a perimeter of the play set 10. As mentioned above, at least one post 14 (e.g. the launching post) is selectively movable with respect to the play set and, in some embodiments, may be pivotally or movably mounted to the play set 10 in order to allow for this movement.

As mentioned above, the launching post is spring biased into the first position such that application of a force to the launching post in order to move it towards the second position creates a biasing force towards the first position. Once the force for moving the launching post toward the second position is released, the launching post moves back towards the first position and can be used to launch an action figure or figurine 21 therefrom.

In one non-limiting embodiment, the play set or toy ring 10 is configured to resemble a wrestling or boxing ring having a platform 22. In one embodiment, the platform 22 is supported by a base member 23 which may be integrally formed with the platform 22, or alternatively platform 22 is a separate component attached to the base member 23. As illustrated, the platform 22 is surrounded by a plurality of posts 14 and elastic bands or elastic members or ropes 16 that define a periphery of the ring of the play set 10. In one embodiment, the surface of the platform 22 is elevated from a surface the base member 23 rests upon.

As illustrated, the plurality of posts 14 are positioned about the platform 22 and a plurality of ropes or elastic members 16 are secured to each of the plurality of posts 14. In one embodiment, the elastic bands or elastic members 16 aid in providing the aforementioned biasing force when the launching post is moved into the second position.

In some embodiments, the elastic bands 16 are the only means for providing the biasing force. Although only four posts 14 are illustrated it is of course contemplated for more or less than four posts 14 can be used in various embodiment of the present invention. Also, a plurality of turnbuckles 18 are fixedly connected to each post 14 along the longitudinal length of post 14 wherein each turnbuckle 18 is configured to slidably receive the elastic members 16 therein to allow for the movement of at least one post 14 between its first and second positions.

In other embodiments, one or more posts 14 may be spring biased or spring loaded into the first position by a spring member 60 secured to the post 14. As illustrated, the spring-loaded post 14 is configured to selectively receive an action figure or figurine 21 and correspondingly launch the action figure or figurine 21 therefrom when the post 14 is released from its second position. The spring-loaded post 14 can be configured to launch the action figurine 21 from an action point 80, 100 that is coupled to an end of the post 14. The action point 80, 100 may cooperate with the post 14 to removably retain a portion of an action figure or figurine 21 and launch the action figure or figurine 21 into the play set 10 by moving the post 14 in a first direction from its first position to its second position and releasing the same so that the post 14 springs back towards the first position by travelling in a second direction which is generally opposite to the first direction. At this point the post 14 stops at the first position and thereby launches the action figure or figurine 21 therefrom.

Figure 2A:
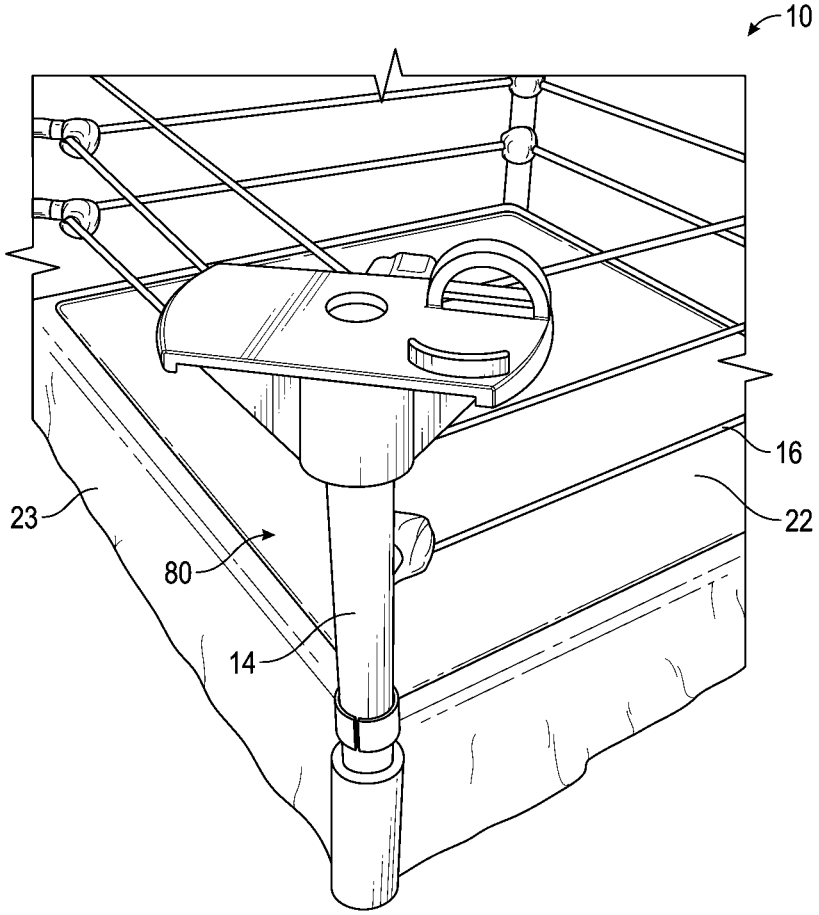
FIG. 2A is a perspective view of the play set or toy ring illustrating at least one spring biased post in a first position.
Figure 2B:
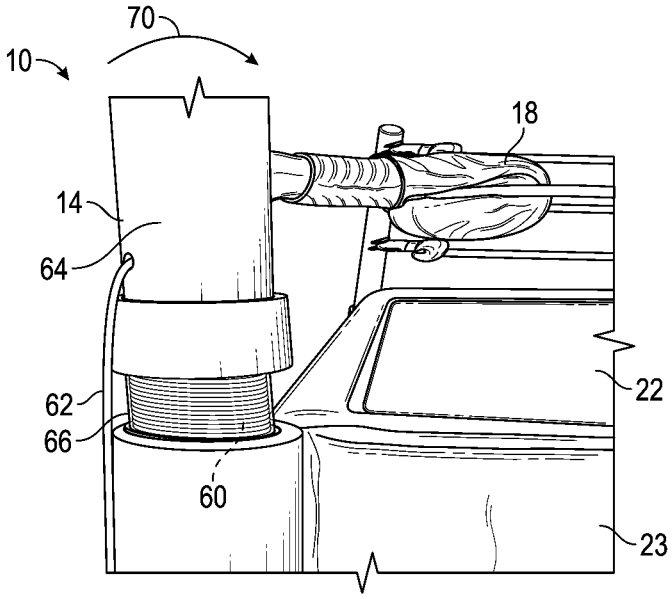
FIG. 2B is a view of a portion of the post illustrated in FIG. 2A.
Figure 2C:
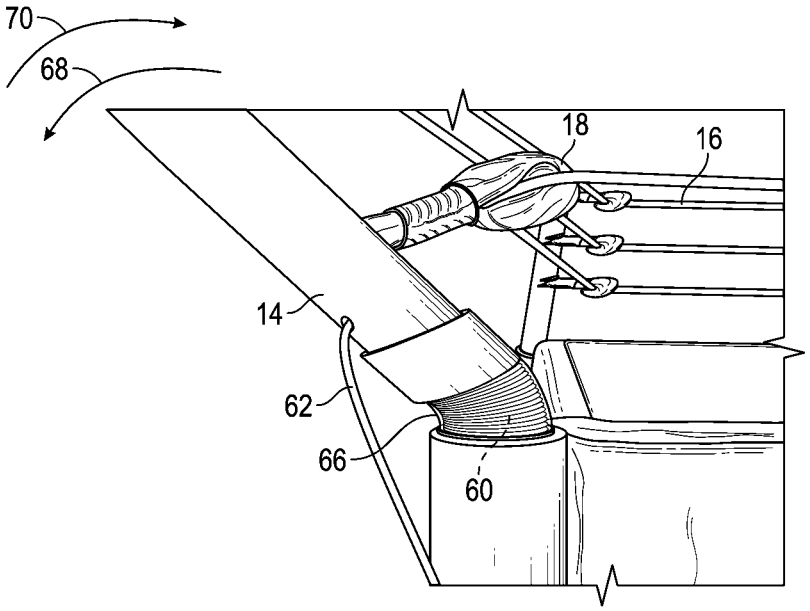
FIG. 2C is a perspective view of the post of FIG. 2A in a second position.

Referring now to FIGS. 2A-2C, one non-limiting embodiment of the play set 10 is illustrated. In this embodiment, the post 14 is secured to the base/platform 23/22 with a spring 60. As illustrated, the spring 60 is located between a bottom portion of the post 14 and a complimentary feature of the base 23. In this embodiment, a stopping member or mechanism 61 such as, for example, a string or elongated member 62 may be provided to prevent over travel of the post 14. The stopping member or mechanism 61 prevents further travel of the post 14 in the second direction once it has reached the first position.

The string or elongated member 62 may be formed from a material that has very little elasticity associated with it such that the string or elongated member 62 does not stretch or elongate once the post 14 reaches its first position after traveling thereto from its second position due to the biasing force of the biasing member(s). In one contemplated embodiment, the string or elongated member 62 is made from a fibrous material with minimal or little stretching capabilities. As such, the stopping member or mechanism 61 prevents the post 14 from extending over platform 22 and/or rebounding out of the "original" or the first position after its return from an extended position or the second position by traveling in the second direction. In other words, the stopping member or mechanism 61 prevents further movement of the post 14 once it has reached its first position after traveling thereto from the second position in the second direction due to the spring biasing force.

As illustrated, the spring 60 couples a lower end 64 of post 14 to the base 23. As the elastic members 16 are stretched due to movement of the post 14 from its first position to its second position, the elastic members 16 may additionally provide a spring biasing force to post 14 as the post 14 is selectively pivoted from its first position to its second position, which is further away from the play set 10.

In one embodiment, a casing 66 may encapsulate the spring 60. The casing 66 may be constructed out of a flexible material to allow for movement of the post 14 as well as spring 60. The casing 66 may aid in preventing a user's fingers from being trapped or pinched by the spring 60 during play when the post 14 is flexed or pivoted outward in the direction of arrow 68 (shown in FIG. 2C). In operation, the post 14 may be configured to be pivoted or flexed from its first position to its second position by, for example, a user grasping and moving the post 14 in the direction of arrow 68 (shown in FIG. 2C).

In its spring-loaded position, the post 14 is at an angle to the first position (shown in FIG. 2C). Upon releasing the post 14 from this position, the spring 60 quickly compresses back to its original position and causes the post 14 to "spring back" in the direction of arrow 70 (shown in FIGS. 2B-2C) towards the platform 22 of play set 10 such that the post 14 returns to its first position. The string 62 restrains the post 14 from oscillating or moving back and forth substantially beyond the first position after post 14 is released from its spring-loaded position or second position. Particularly, the string 62 minimizes or dampens the oscillations from the spring 60 and thus provides a relatively hard stop of the post 14 at its first position after release from its second position.

Figure 3A:
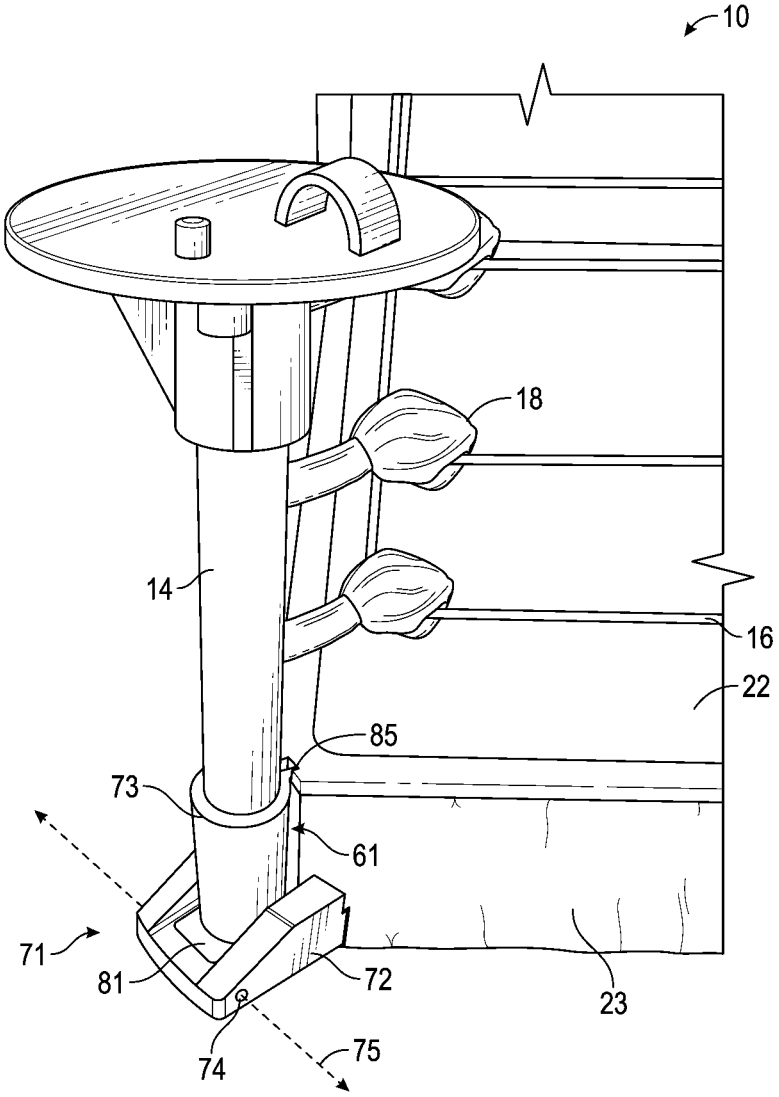
FIG. 3A is a perspective view of a play set or toy ring according to another embodiment illustrating at least one spring biased post in a first position.
Figure 3B:
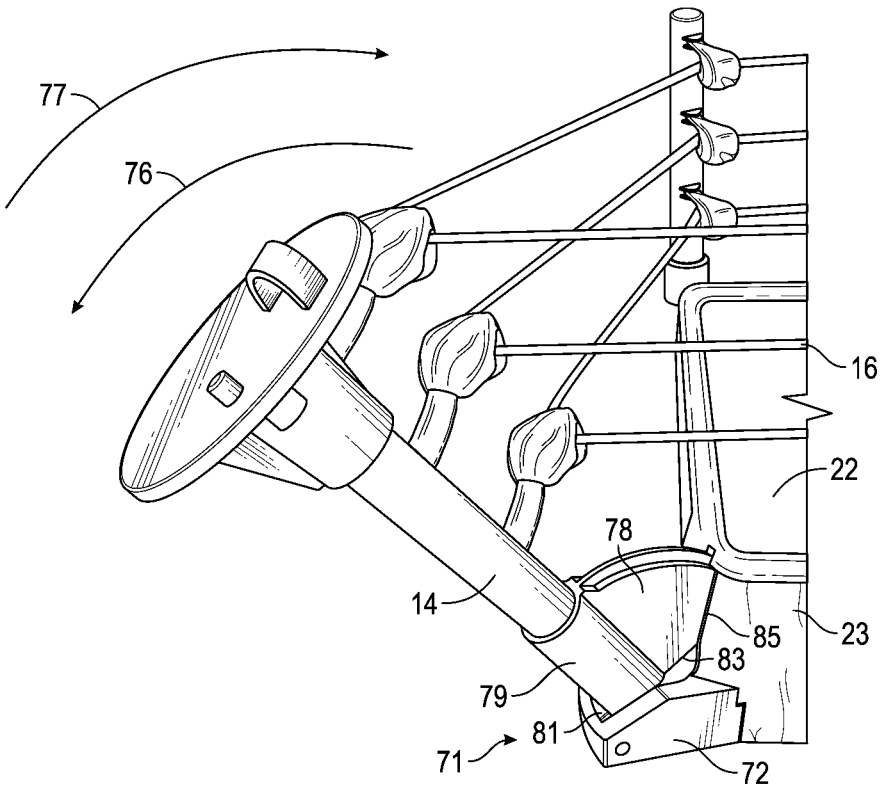
FIG. 3B a perspective view illustrating the post of FIG. 3A moved into a second position.

Referring now to FIGS. 3A-3B and in another non-limiting embodiment, play set 10 includes at least one post 14 that is hingedly or pivotally connected to the base 23 with a hinge assembly 71. The play set 10 also includes one or more ropes or elastic members 16 that are coupled to the post 14 through one or more turnbuckles 18. In the illustrated embodiment, the post 14 is configured to be pivoted from an original position or first position where post 14 is generally orthogonal to a plane of the platform 22 in a first direction to a pivoted position or second position where the post 14 is at an angle from the original position (shown in FIG. 3B). The pivoting may be accomplished by application of a force to the post 14 such as, for example, a user grasping and moving the post 14 in the direction of arrow 76, which corresponds to the first direction. Moving the post 14 in direction of arrow 76 applies an expansive force to the elastic members 16. The elastic members or ropes 16 under the application of this force are elastically loaded when the post 14 is in the second position. Upon releasing the post 14 by the user, the post 14 quickly springs back in the second direction or in the direction of arrow 77 towards platform 22. This is caused by a force applied to the post 14 by the elastically deformed ropes or elastic members 16 when the post 14 is moved into the second position. In some embodiments, the play set 10 includes a stopping mechanism that restrains the post 14 from oscillating or moving back and forth substantially beyond the original first position after being released from its elastically-loaded position or second position.

Also illustrated is that the hinge assembly 71 includes a stationary base 72 and a movable member 73. The stationary base 72 is connected to the base 23 and is configured to receive the movable member 73 therein. In the illustrated embodiment, the stationary base 72 is connected to a vertex or corner of the base 23. The movable member 73 is generally tubular and is coupled to the stationary base 72 with a hinge pin 74 that is aligned on an axis 75. The post 14 is coupled to the movable member 73 along a longitudinal axis of the movable member 73. When a force is applied to the post 14 in the direction of arrow 76, the post 14 pivots away from play set 10 along with movable member 73 about axis 75 of the hinge pin 74. When the force in the direction of arrow 76 is released from being applied to the post 14, the post 14 and the movable member 73 pivots back towards the play set 10 about axis 75 of the hinge pin 74 in the direction of arrow 77.

Also illustrated in FIGS. 3A-3B is that stationary base 72 includes an opening 81 that is configured to receive the movable member 73. In the illustrated embodiment, the movable member 73 is molded as a single piece and includes a generally triangular or pie shaped wedge member or guiding member 78 (FIG. 3B) that extends from a generally cylindrical portion 79. The cylindrical portion 79 is configured to pivot about axis 75 and receive a portion of the post 14 therein. In an alternative embodiment, the post 14 may be integrally formed with cylindrical portion 79. The wedge member 78 is configured to be movably received within a cavity or slotted opening 85 in base 23. The wedge member 78 and opening 85 are configured such that when the post 14 is in the first position, the wedge member 78 is completely or a substantially portion of the wedge member 78 (for example, greater than 75%) is received within opening 85. Of course, other percentages greater or less than 75% are considered to be with the scope of various embodiments of the present invention. When the post 14 is moved to the second position, a portion of the wedge member 78 extends out of opening 85 while another portion remains in opening 85 thus, wedge member 78 guides the travel of the post 14 and also prevents a user's fingers from being caught between the cylindrical portion 79 and the base 23. In one embodiment, the cylindrical portion 79 extends all the way up to at least the platform 22 or a top edge of the base 23 and a top of the wedge member 78 also extends upwardly to at least the platform 22 or the top edge of the base 23 in order to prevent a user's fingers from being caught between the cylindrical portion 79 and the base 23.

Upon releasing the post 14 from the second position, the elastic members 16 compress by releasing energy stored therein and cause the post 14 to quickly spring back in direction of arrow 77 (shown in FIGS. 3B-3C) towards the first position with respect to the platform 22 of play set 10. The wedge member 78 is generally obscured from view under the platform 22 in this position. The wedge member 78 is configured to prevent a user from having their finger or fingers pinched between the post 14 and/or the cylindrical portion 79 and the base 23 when the post 14 is released from the second position and moves back towards the first position.

In some embodiments, the play set 10 and in particular the play set 10 illustrated in FIGS. 3A and 3B may include a stopping member or mechanism 61 to dampen or minimize oscillations in the post 14 once it moves back to the first position. The stopping member or mechanism 61 may be the cylindrical portion 79 which is larger than opening 85 the wedge member 78 travels in. Accordingly and when the post 14 is in the first position, the cylindrical portion 79 contacts the base 23 proximate to the opening 85 and thus limits the travel of the post 14 in the second direction once it has reached the first position. Wedge member 78 also acts as a guide to direct the path of travel of the post 14 in the second direction. The stopping member or mechanism 61 may also be provided by a bottom surface 83 of the wedge member 78 that contacts the base 72 or any other equivalent structure or surface when the post 14 is in the first position and is spaced from the base 72 or any other equivalent structure or surface when the post 14 is in the second position. Accordingly and when the post 14 moves from the second position to the first position, the bottom surface 83 contacts the base 72 and stops its movement in the direction of arrow 77 in order to launch figurine 21 therefrom as well as prevent oscillatory movement of the post 14 back and forth after it is released from the second positon. It is understood that the stopping member or mechanism 61 may be solely provided by bottom surface 83 or in an alternative embodiment may be in combination with cylindrical portion 79. In addition and in yet another alternative embodiment, the stopping mechanism 61 may be solely provided by cylindrical portion 79.

Figure 4A:
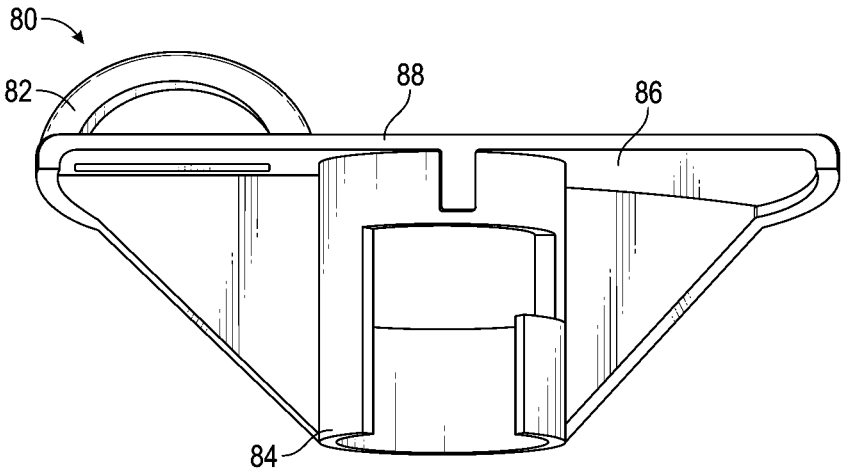
FIG. 4A is a side view of an action point or component of the play set configured for use with a post of the play set.
Figure 4B:
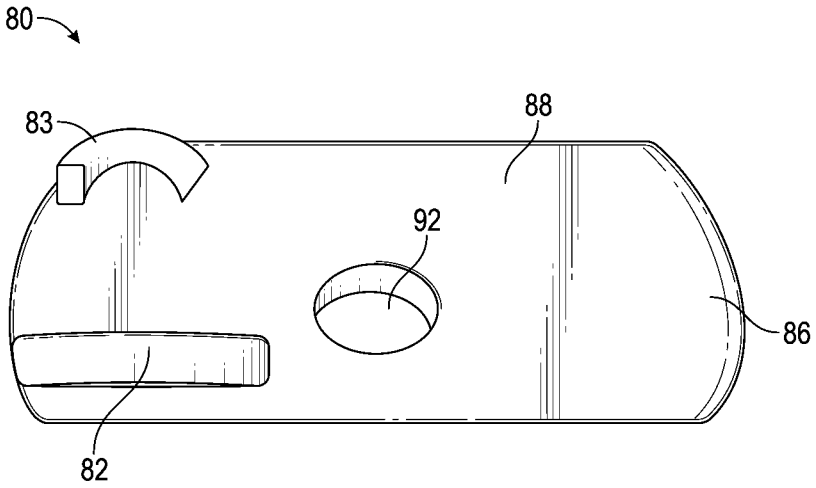
FIG. 4B is a top view of the action point or component illustrated in FIG. 4A.
Figure 4C:
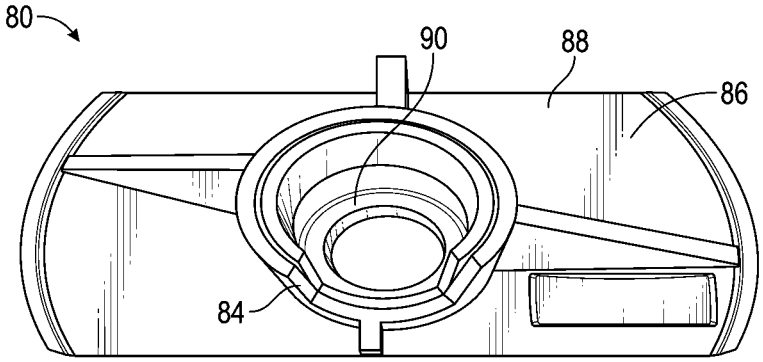
FIG. 4C is a bottom view of the action point or component illustrated in FIG. 4A.

Referring now to FIGS. 4A-4C and in one embodiment, the action point 80 for the play set 10 is illustrated. As illustrated, the action point 80 is configured to have a plurality of engagement features 82, 83 and a retaining member 84. The engagement features 82, 83 are configured to retain and subsequently release a portion of an action figure or figurine 21 while the retaining member 84 is configured to removably engage at least one of the plurality of posts 14 above the plurality of ropes 16.

As shown in FIGS. 4A-4C and in one non-limiting embodiment, the action point 80 is molded as a single piece and includes a rigid body 86 and a generally planar platform 88 that is generally orthogonal to the retaining member 84. In some embodiments, the retaining member 84 is generally aligned at a mid-point of the platform 88. But, in other embodiments, the retaining member 84 may be coupled at a non-midpoint to the platform 88. The retaining member 84 includes a through-opening or bore 90. Additionally, the platform 88 includes a second through-opening 92 that is aligned along the same axis as bore 90 in order to form a continuous opening through body 86. In operation, the action point 80 is configured to removably engage at least one of the plurality of posts 14 through the retaining member 84. The retaining member 84 may allow for the placement of the action point 80 on any of the plurality of posts 14 and in some embodiments, in at least two orientations, for example, two orientations 180 degrees offset from each other. It is also understood that multiple orientations of the action point 80, 100 in various degrees greater or less than 180 degrees as well as various configurations of the action point 80, 100 are considered to be within the scope of various embodiments of the prevent invention.

Also shown in FIGS. 4A-4C is that the platform 88 includes a plurality of engagement features 82, 83. Engagement feature 82 is generally semi-circular in shape and includes an opening that is configured to receive a portion of an action figure or figurine 21 such as, for example, a forefoot area of the action figure or figurine 21. Engagement feature 83 is also semi-circular in shape but is oriented in order to receive another portion of the action figure or figurine 21 such as, for example, a hind foot (e.g., a heel area) of the action figure or figurine 21. In various embodiments, the action point 80 is configured to engage and release a portion of an action figurine 21 that is disposed in one of the plurality of engagement features 82, 83. Although only one action figurine 21 is discussed and shown in the attached figures, it is, of course, understood that numerous action figurines 21 are contemplated to be used with various embodiments of the invention. For example, suitable action figurines 21 may be those available from the MATTEL FLEXFORCE® line of products. Similarly, the action point 80 can be configured to have numerous configurations and arrangements wherein the number of engagement features can be increased or decreased as well as changing the configuration of the same.

Figure 5:
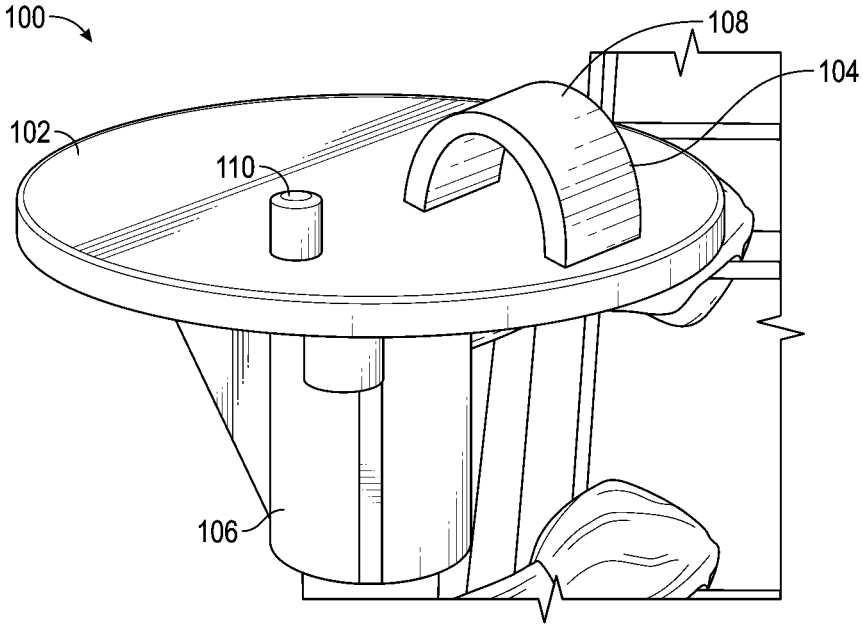
FIG. 5 is a side perspective view of the action point or component according to another embodiment secured to the post of the toy ring.

In another embodiment and as illustrated in FIG. 5, the action point 100 is molded as a single piece and includes a generally circular planar platform 102. Action point 100 includes a rigid body 104 and a generally planar platform 102 that is orthogonal to a retaining member 106. In operation, the action point 100 is configured to removably engage at least one of the plurality of posts 14 through the retaining member 106. The retaining member 106 allows for the placement of the action point 100 on any one of the plurality of posts and in one embodiment, in at least two orientations 180 degrees offset from each other. It is to be appreciated that multiple orientations and configurations are within exemplary embodiments of the invention.

Also shown in FIG. 5, the platform 100 includes a plurality of engagement features 108, 110. The engagement feature 108 is generally semi-circular in shape and includes an opening that is configured to receive a portion of an action figure or figurine 21 such as, for example, a forefoot area of the foot of the action figure or figurine 21. Engagement feature 110 is generally cylindrical in shape and is configured to be inserted into a complimentary opening in a distal bottom portion of the foot of the action figure or figurine 21 such as, for example, a hind foot area.

In operation and referring initially to FIG. 1, action figure or figurine 21 is shown engaging an action point 100. It is to be appreciated that action point 100 may be used for discussion purposes. But, in other embodiments, action point 80 may also be used in lieu of action point 100 in order to launch the action figurine or figure or figurine 21 with play set 10. In this embodiment, the portion of the action figure or figurine 21 engaging the action point 100 is a single foot 13 configured to be received within the engagement features 108, 110. In order to generate a force to launch the action figurine 21 from the action point 100 after the foot 13 is engaged by the engagement features, a force is applied to the post 14 (FIG. 1) in the direction of arrow 17 by for example, a user's hand wherein the post 14 moves or pivots in the direction of arrow 17 (See also FIG. 2C or 3B). In this position, the spring 60 (FIG. 2B) and/or the elastic members 16 (FIG. 3B) are expanded thereby storing or generating a launching force in a direction opposite to arrow 17.

Once a user's hand is removed, the force in the direction opposite to arrow 17 is released and the post 14 moves in the direction opposite to arrow 17 by a compressive force applied by the spring 60 (FIG. 2B) and/or the elastic ropes or elastic members 16 (FIG. 3B) and the action figure or figurine 21 moves from the second position towards the platform 22. In so doing, the post 14 stops at the first position and the action figure or figurine 21 will launch from the action point 100 towards the platform 22 of the play set or toy ring 10.

In an alternative method of operation, the action figure or figurine 21 may be placed with its back side against the post 14. In some embodiments, the back side may be placed against one or more turnbuckles 18 on the post 14. A user then pulls or pivots the post 14 from its first position to its second position, and, upon releasing the post 14 from its second position, the stored energy in the spring 60 and/or the ropes 16 may be transferred to the action figure or figurine 21 to send the action figurine 21 flying into or across the platform 22 and perhaps crashing into a different toy or accessory.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A toy ring, comprising:

a platform;

a plurality of posts positioned about the platform, the plurality of posts including at least one launching post configured for movement between a first position and a second position, wherein movement from the first position to the second position is in a first direction away from the platform;

a single elastic member, wherein a different portion of the single elastic member is secured to each one of the plurality of posts; and a biasing member distinct from the elastic member for providing a biasing force to the launching post in a second direction opposite to the first direction when the launching post is in the second position.

2. The toy ring as in claim 1, wherein the biasing member is a spring that secures a lower portion of the launching post to the platform.

3. The toy ring as in claim 2, wherein the spring is located between the lower portion of the launching post and the platform.

4. The toy ring as in claim 2, wherein the spring is encapsulated with a flexible member.

5. The toy ring as in claim 1, wherein the launching post is configured to removably support an action figurine.

6. The toy ring as in claim 1, wherein the elastic member also provides a biasing force to the launching post in the second direction when the launching post is in the second position.

7. The toy ring as in claim 1, further comprising one or more additional elastic members, the single elastic member and the one or more additional elastic members provide a biasing force to the launching post in the second direction when the launching post is in the second position.

8. The toy ring as in claim 7, further comprising a turnbuckle coupled to each one of the plurality of posts, wherein each turnbuckle is configured to receive and retain a different portion of the single elastic member and a different portion of the one or more additional elastic members.

9. The toy ring as in claim 1, wherein the launching post is pivotally mounted to the platform at one end.

10. The toy ring as in claim 1, wherein the platform is configured to define a limit of travel for the one of the plurality of posts in the second direction.

11. The toy ring as in claim 1, wherein the toy ring is configured to resemble a wrestling ring.

12. A toy ring, comprising:

a platform;

a plurality of posts positioned about the platform, the plurality of posts including at least one launching post pivotally mounted to the platform at a first end and configured for movement between a first position and a second position, where a second end of the launching post, opposite the first end, moves in a first direction away from the platform when the launching post is moved from the first position to the second position; and a single elastic member, wherein a different portion of the single elastic member is secured to each one of the plurality of posts, wherein the single elastic member provides a biasing force to the launching post in a second direction opposite to the first direction when the launching post is in the second position.

13. The toy ring as in claim 12, wherein the second end of the launching post is configured to removably support an action figurine.

14. The toy ring as in claim 12, wherein the second end of the launching post is configured to removably receive an action point configured to removably support an action figurine.

15. The toy ring as in claim 12, wherein the launching post is pivotally mounted to the platform via a hinge assembly having a movable member pivotally mounted to a stationary base, wherein the movable member is configured to receive a portion of the launching post therein.

16. The toy ring as in claim 15, wherein the movable member further comprises a guiding member that extends from a cylindrical portion and wherein the cylindrical portion is configured to pivot about an axis and receive a portion of the launching post therein, wherein the guiding member is configured to be movably received within an opening in a base supporting the platform, wherein the guiding member and the opening are configured such that when the launching post is in the first position, the guiding member is substantially received within the opening and when the launching post is moved to the second position, a portion of the guiding member extends out of opening while another portion of the guiding member remains in the opening.

17. The toy ring as in claim 12, further comprising one or more additional elastic members, the single elastic member and the one or more additional elastic members provide the biasing force to the launching post in the second direction when the launching post is in the second position, and wherein each one of the plurality of posts has a turnbuckle coupled to each one of the plurality of posts, wherein each turnbuckle is configured to receive and retain a different portion of the single elastic member and a different portion of the one or more additional elastic members.

18. The toy ring as in claim 12, further comprising a guiding member that defines a limit of travel for the launching post in the second direction.

19. The toy ring as in claim 12, wherein the launching post further comprises a guiding member configured to be slidably received within an opening of the platform as the launching post is moved between the first position and the second position.

20. In combination a toy wrestling ring and at least one action figurine, wherein the toy wrestling ring has:

a platform;

a plurality of posts positioned about the platform, the plurality of posts including at least one launching post pivotally mounted to the platform at a first end and configured for movement between a first position and a second position, where a second end of the launching post, opposite the first end, moves in a first direction away from the platform when the launching post is moved from the first position to the second position;

an elastic member secured to each one of the plurality of posts, wherein the elastic member provides a biasing force to the launching post in a second direction when the launching post is in the second position, the second direction being opposite to the first direction; and an action figurine configured to be removably secured to the second end of the launching post, such that movement of the launching post from the second position to the first position with the action figurine located on the second end of the launching post propels the action figurine into or over an area of the ring surrounded by the plurality of posts and the elastic member.

21. The combination of claim 20, wherein the launching post further comprises a guiding member configured to be slidably received within an opening of the platform as the launching post is moved between the first position and the second position.

* * * * *